US011641982B2

(12) United States Patent
Hayden et al.

(10) Patent No.: US 11,641,982 B2
(45) Date of Patent: May 9, 2023

(54) PORTABLE HAND WASHING STATION

(71) Applicant: Rheem Manufacturing Company, Atlanta, GA (US)

(72) Inventors: Christopher M. Hayden, Shelton, CT (US); Harsha Satyanarayana, Bristol, CT (US); Jens Bolleyer, Waterbury, CT (US); Atilhan Manay, Waterbury, CT (US); Andrew David Zortman, Waterbury, CT (US); Travis Miller, Waterbury, CT (US)

(73) Assignee: Rheem Manufacturing Company, Atlanta, GA (US)

( * ) Notice: Subject to any disclaimer, the term of this patent is extended or adjusted under 35 U.S.C. 154(b) by 155 days.

(21) Appl. No.: 17/337,597

(22) Filed: Jun. 3, 2021

(65) Prior Publication Data

US 2021/0378454 A1 Dec. 9, 2021

Related U.S. Application Data

(60) Provisional application No. 63/035,295, filed on Jun. 5, 2020.

(51) Int. Cl.
*A47K 1/02* (2006.01)
*E03C 1/044* (2006.01)

(52) U.S. Cl.
CPC ..... *A47K 1/02* (2013.01); *E03C 1/044* (2013.01)

(58) Field of Classification Search
CPC ..... A47K 1/02; E03C 1/04; E03C 1/044
USPC ..... 4/625
See application file for complete search history.

(56) References Cited

U.S. PATENT DOCUMENTS 6,173,458 B1 * 1/2001 Maddux ..... A47K 1/02 4/619
6,253,394 B1 * 7/2001 Goyette ..... E03C 1/01 4/626
6,959,460 B2 * 11/2005 Patterson ..... A47K 1/02 4/625
10,271,691 B1 * 4/2019 Boyle ..... A47K 1/02
2001/0052681 A1 * 12/2001 Deavila ..... A47K 1/02 280/47.35
2003/0019031 A1 * 1/2003 Mosis ..... E03C 1/18 4/625

(Continued)

FOREIGN PATENT DOCUMENTS

WO WO-2017136209 A1 * 8/2017 ..... B05B 1/06

OTHER PUBLICATIONS

PortableHandwashing.com, <https://www.portablehandwashing.com>, accessed Aug. 3, 2022.

(Continued)

*Primary Examiner* — Benjamin R Shaw
(74) *Attorney, Agent, or Firm* — Eversheds Sutherland (US) LLP

(57) ABSTRACT

The disclosed technology includes a portable hand washing station having a sink with an atomizing nozzle that can provide an ultra-low flow of atomized liquid. The atomizing nozzle can reduce consumption of water and reduce the required supply of power for adequate operation of a heating device and a pump of the portable hand washing station. The heating device can include insulation, such that the heating device can provide heated water during an extended operation period.

19 Claims, 7 Drawing Sheets

(56) References Cited

U.S. PATENT DOCUMENTS

| | | | | |
|---|---|---|---|---|
| 2007/0199146 | A1* | 8/2007 | Kostelyk | E03B 11/02 4/625 |
| 2014/0366262 | A1* | 12/2014 | Flynn | A47K 3/32 4/514 |
| 2019/0211535 | A1* | 7/2019 | Gallob | E03C 1/05 |
| 2021/0321829 | A1* | 10/2021 | Shell | A47K 1/02 |

OTHER PUBLICATIONS

SoapWell by Elka, <https://www.berls.com/elkay-mhs2424hf-touchless-hand-washing-station>, accessed Aug. 3, 2022.

* cited by examiner

PORTABLE HAND WASHING STATION

CROSS-REFERENCE TO RELATED APPLICATION

This application claims the benefit of U.S. Patent Application No. 63/035,295, filed on 5 Jun. 2020, the entire contents and substance of which is incorporated herein by reference as if fully set forth below.

FIELD OF THE DISCLOSURE

The present invention relates generally to a portable hand washing station, and more particularly, to a portable hand washing station configured to provide an ultra-low flow of water and/or having enhanced mobility.

BACKGROUND

Portable hand washing stations have become increasingly popular as a way to prevent the spread of germs and viruses at many locations and are particularly useful in remote locations where existing hand washing solutions are uncommon or unavailable. Portable hand washing stations can provide significant advantages, including the ability to wash hands without traditional plumbing systems or water installation.

Traditional portable hand washing stations able to provide heated water can include a water heater and a connection to the pressurized water supply line. In order to operate, the portable hand washing station can connect to a standard power outlet. However, in some remote and non-remote areas, a water supply line and/or electricity can be unavailable. Additionally, in some locations a water supply line and/or electricity can be undesirable, as an extended cable or water hose could increase the risk of tripping or other hazards.

In addition, because portable hand washing stations can store only a finite amount of clean water (i.e., clean water ready to be used for washing a user's hands), existing hand washing stations can quickly experience a depleted supply of water after a relatively small number of handwashes. For example, some current portable hand washing stations that include a six-gallon clean water tank can provide only approximately 30 twenty-second hand washes before the supply of clean water is depleted. Thus, these stations must be restocked with clean water frequently, resulting in a high operational cost. Alternatively, these stations can be designed to include a large supply of clean water; however, a large tank of clean water can increase the weight of the station, and thus, decrease mobility.

SUMMARY

These and other problems can be addressed by the technologies described herein. Examples of the present disclosure relate generally to a portable hand washing station including an atomizing nozzle to provide an ultra-low flow of atomized liquid from a faucet of a sink.

The disclosed technology includes a portable hand washing station including a housing defining a cavity and a sink attached to the housing. The sink can include a faucet having an atomizing nozzle that can provide an ultra-low flow of atomized liquid and a basin having a drain. The portable hand washing station can include a clean water tank and a waste water tank within the cavity of the housing. The clean water tank can be in fluid communication with the faucet and the waste water tank can be in fluid communication with the drain. The portable hand washing station can include a pump configured to transport liquid from the clean water tank to the faucet and a heating device configured to heat liquids. The heating device can be in fluid communication with the clean water tank and the faucet.

The disclosed technology can also include a portable hand washing station including a housing defining a cavity and a sink attached to the housing. The sink can include a faucet having an atomizing nozzle that can provide an ultra-low flow of atomized liquid and a basin having a drain. The portable hand washing station can include a waste water tank and a pressure tank within the cavity of the housing. The waste water tank can be in fluid communication with the drain and the pressure tank can be in fluid communication with the faucet. The pressure tank can be configured to provide pressurized water during an operation period. The pressure tank can include a steel shell, a water portion having a watertight liner, an air portion, and an air valve disposed on the shell. The portable hand washing station can include a heating device configured to heat liquids. The heating device can be in fluid communication with the pressure tank and the faucet.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
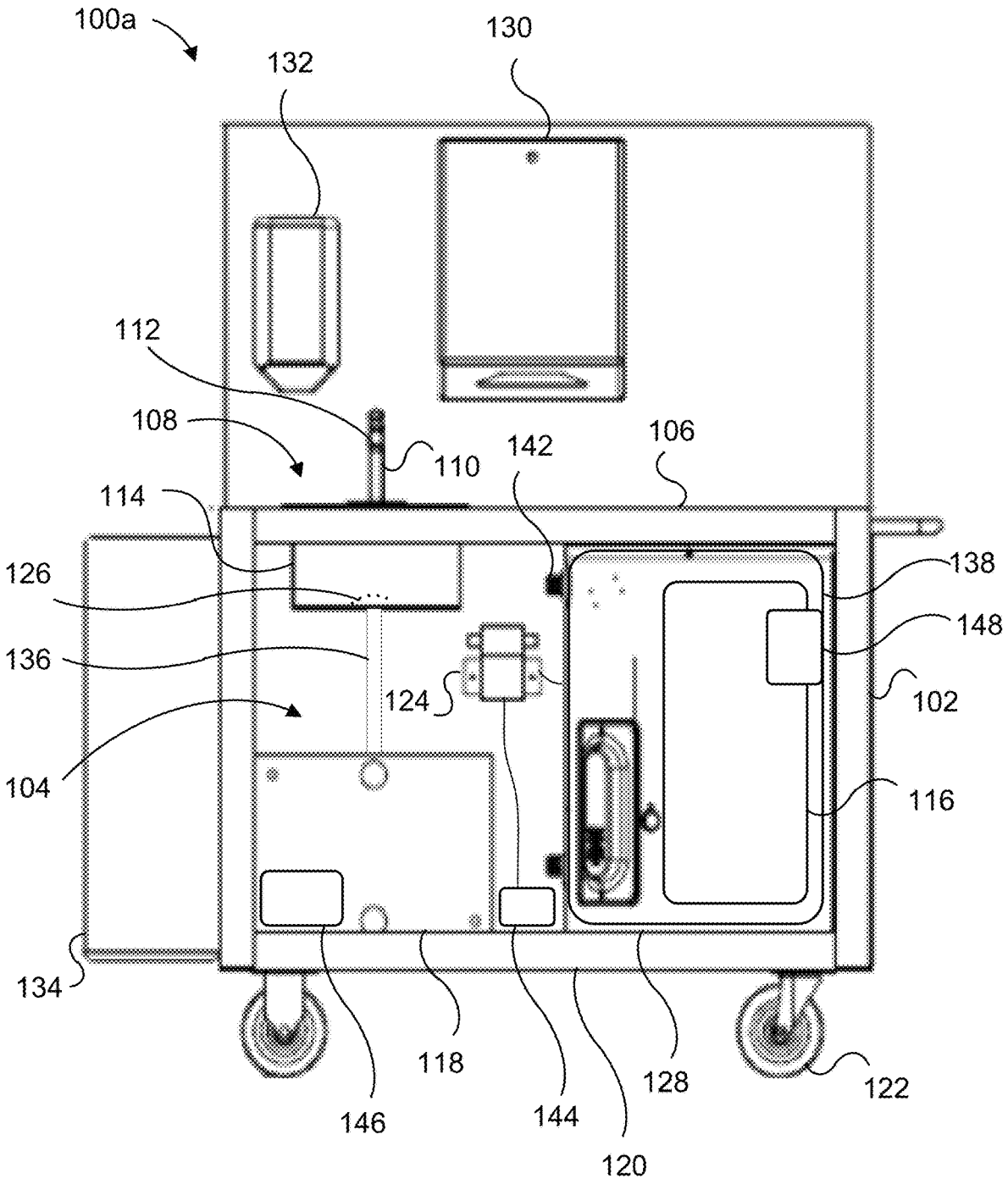
FIGS. 1A-1D illustrate example variations of a portable hand washing station configured to provide an ultra-low flow of water, in accordance with the disclosed technology.

The disclosed technology includes a portable hand washing station having an atomizing nozzle that can provide an ultra-low flow of water, resulting in reduced consumption of water. By reducing the amount of water necessary for an individual hand wash, the portable hand washing station can reduce the power supply required for adequate operation of a heating device and a pump of the portable hand washing station. Additionally, by reducing the amount of water necessary for a hand wash, the clean water tank of a portable hand washing station can be relatively small, and thus, the station can be moved and transferred with ease. The portable hand washing station can optionally include an insulated tank, which can help provide heated water for an extended period of time without the need for additional power.

The disclosed technology also includes a pressure tank configured to pressurize water stored within the pressure tank such that the water can be dispensed without a pump. The pressure tank can be integrated into the portable hand washing station, which can permit the portable hand washing station to effectively operate for an extended period of time without a pump or power (e.g., corded power or a battery).

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," "one example," "an example," "some examples," "certain examples," "various examples," etc., indicate that the embodiment(s) and/or example(s) of the disclosed technology so described may include a particular feature, structure, or characteristic, but not every embodiment necessarily includes the particular feature, structure, or characteristic. Further, repeated use of the phrase "in one embodiment" or the like does not necessarily refer to the same embodiment, example, or implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween. Further, the expression that a property "can be between approximately 2 and approximately 4" is also inclusive of the endpoints, meaning that the property can be approximately 2, can be approximately 4, or can be any value therebetween.

Unless otherwise specified, the terms liquid and/or water disclosed herein are inclusive of pure water ($H_2O$) and pure water plus any additives or additional component. Furthermore, while the disclosed systems, devices, and methods are described herein with reference to water, they can be used with other liquids, such as solutions including antibacterial agents.

Unless otherwise specified, the term ultra-low flow disclosed herein means a flow of atomized liquid having a flow rate between approximately 0.01 gallons per minute and approximately 0.5 gallons per minute.

Reference will now be made in detail to examples of the disclosed technology and the accompanying drawings. Wherever convenient, the same references numbers will be used throughout the drawings to refer to the same or like parts.

FIGS. 1A through 1D illustrate examples of a portable hand washing station 100 configured to provide an ultra-low flow of atomized water. FIG. 1A illustrates an example portable hand washing station 100*a* including a sink 108 having a faucet 110 with an atomizing nozzle 112, a heating device 128 including a clean water tank 116, a waste water tank 118, and a pump 124.

The portable hand washing station 100*a* can include a housing 102 defining a cavity 104. The housing 102 can include a top surface 106 and a bottom surface 120. The housing 102 can have a length, a width (or depth), and height, and these dimensions can differ depending on the application (e.g., the environment in which the portable hand washing station 100*a* will be used). The height can be based upon the average height of individuals who will be using the portable hand washing station 100*a*. For example, the height can be between approximately 20 inches and approximately 48 inches. The width and/or the length can be based on the size of the components stored within the cavity 104. For example, the length can be between approximately 20 inches and approximately 50 inches, and/or the width can be between approximately 15 inches and approximately 30 inches. The housing 102 can be made substantially of any durable material capable of withstanding environmental forces in remote and non-remote locations. The housing 102 can be made substantially of at least one of stainless steel, granite, quartzite, laminate, wood, plastic, and the like. The portable hand washing station 100*a* can include one or more wheels 122 affixed to the bottom surface 120 of the housing 102. The wheels 122 can allow the portable hand washing station 100*a* to be easily transported to various locations, thus increasing mobility.

The sink 108 can be affixed to the housing 102. As illustrated in FIG. 1A, the sink 108 can be disposed on the countertop or top surface 106 of the housing 102. The sink 108 can include a faucet 110 having an atomizing nozzle 112. The faucet 110 can be configured to output a flow of water (e.g., atomized water) upon movement of a handle or switch to an "on" position. Alternatively, the faucet 110 can include a proximity sensor or a motion sensor, and the faucet 110 can be motion activated such that the faucet 110 is configured to output a flow of water in response to detecting, via the proximity sensor or motion sensor, the presence of an individual's hand or other object (e.g., within a predetermined distance of the proximity sensor or motion sensor). A motion-activated faucet 110 can be more expensive to install than traditional faucets 110, but such a configuration can help reduce the spread of germs, as high-contact areas are less frequently touched. The atomizing nozzle 112 can provide an ultra-low flow of atomized water as discussed herein. The sink 108 can include a basin 114. The basin 114 can be have any shape. In some instances, the basin 114 can be substantially bowl-shaped. The sink 108 can include a drain 126 in fluid communication with a drain pipe 136 that can transport waste water to the waste water tank 118.

The clean water tank 116 can be disposed within the cavity 104 of the housing 102. The clean water tank 116 can store liquid. In some instances, the liquid within the clean water tank 116 can be pure water. Alternatively, the liquid within the clean water tank 116 can be water plus any additives, including additives used to purify and cleanse the water. The clean water tank 116 can be between approximately five gallons and approximately twelve gallons. The clean water tank 116 can include a low-level switch. When the water stored within the clean water tank 116 becomes less than or equal to a low threshold amount, the low-level switch can disable the pump 124 such that no water is directed from the clean water tank 116 to the faucet 110. As illustrated in FIG. 1A, the clean water tank 116 can be a storage tank of a heating device 128.

The clean water tank 116 can include one or more temperature sensors in electrical communication with a controller and/or circuitry. The one or more temperature sensors can detect and monitor a temperature of the water stored within the clean water tank 116.

The portable hand washing station 100*a* can include a check valve in fluid communication the clean water tank 116. The check valve can prevent back flow, thereby decreased the risk of contaminating the water stored within the clean water tank 116.

As illustrated in FIG. 1A, the heating device 128 can be a tank-based water heater. The heating device 128 can be or include an electric water heater, a heat pump water heater, a gas water heater, a solar powered water heater, a geothermal water heater, or any combination thereof. The heating device 128 can heat the water in the clean water tank 116 to a set temperature. The set temperature can be a predetermined or preset temperature. Alternatively or additionally, the set temperature can be a user-inputted temperature (e.g., via a user interface, via a mobile device communicably coupled to the portable hand washing station 100*a*).

The heating device 128 and/or the clean water tank 116 can be insulated. For example, the heating device can include the clean water tank 116, and the heating device 128 can be insulated. Alternatively, the heating device 128 and the clean water tank 116 can be separate components, and the heating device 128 can be in fluid communication and/or thermal communication with the clean water tank 116 such that heated water can be heated by the heating device 128 and stored in the clean water tank 116. By way of example, the heating device 128 and/or the water tank 116 can have an insulating layer. The insulating layer can be any insulation material that has proper thermal insulation properties to minimize stand by losses including fiberglass, vacuum insulation panels, foam type insulations such as cyclopentane or polyurethane with in place K factors between approximately 0.05 and approximately 0.4 BTU/(h·ft·° F.). The insulating layer can be covered with a shell (e.g., made of steel, aluminum, plastics, or the like) that can be coated with one or more coatings designed to protect the insulated layer from environmental factors. The heating device 128 and/or the clean water tank 116 can include an insulation liner 138 (e.g., internal insulation). As non-limiting examples, the insulation liner 138 can include polyurethane, polycyclopenthane, or the like.

The pump 124 can be in fluid communication with the clean water tank 116. The pump 124 can pressurize water flowing from the clean water tank 116 to the faucet 110. For example, the pump 124 can pressurize the water to a pressure between approximately 20 and approximately 60 psi. The pump 124 can be an electric pump. The pump 124 can include or be connected to a battery 142 (e.g., a rechargeable battery). Such a battery 142 could also be configured to power the heating device 128 and any other component of the portable hand washing station 100*a*. The pump 124 can include an integrated pressure switch, and the integrated pressure switch can turn the pump 124 on upon receiving a demand for pressurized water and can turn the pump 124 off when there is no demand for pressurized water.

The portable hand washing station 100*a* illustrated in FIG. 1A, including the pump 124 and the heating device 128, can be in electrical communication with a main power supply via one or more power cord. The heating device 128 and the pump 124 can be in electrical communication with a main power supply via the same power cord. Alternatively, the heating device 128 can be in electrical communication with the main power supply via one power cord, and the pump 124 can be in electrical communication with the main power supply via an additional power cord. The power cord(s) can be adapted to plug into a standard wall outlet, for example. The main power supply can provide power to the heating device 128 and the pump 124. By way of example, the main power supply can provide between approximately 1.0 kW and approximately 2.2 kW of power to the heating device 128 and the pump 124.

Alternatively, the pump 124 can be powered from the battery 144. The battery 144 can be charged during a period of use (e.g., at night) such that the pump 124 can be operable during a period of use (e.g., during the day). When the main power supply is connected to the portable hand washing station 100*a*, the main power supply can transmit power and charge the battery 142 using a step down transformer 148. The main power supply can energize elements of the heating device 128 over night at the same time. In this configuration, a drain pump 146 can drain waste water from the waste water tank 118 automatically and quickly, thereby saving time and effort for the user. The drain pump 146 can be powered from the battery 144 or a different battery 144. The drain pump 146 can be activated by a user switch at the end of the operational day.

The heating device 128 can have a water level sensor 142 to prevent energizing the elements when there is not water in the clean water tank 116 of the heating device 128. The water level sensor 142 can be a level switch. Alternatively, the water level sensor 142 can be a mechanical float valve or any other switch useful in conjunction with liquids. If the water level sensor 142 does not detect a proper water level in the clean water tank 116 of the heating device 128, the water level sensor 142 can output a signal to a controller and/or circuitry to shut off power supply. This can prevent dry firing of the heating device 128.

As described above, the heating device 128 and/or the water tank 116 can have insulative properties. In such configurations, the water stored in the clean water tank 116 can be heated to the set temperature, and the heating device 128 can then be disconnected from the main power supply. Alternatively or additionally, the water can be heated by an external device, and heated water can be introduced into the insulated water tank 116; in such configurations, the portable hand washing station 100*a* can omit a heating device 128 while still being able to portably provide heated water. The water within the clean water tank 116 can maintain the set temperature for at least an operational period. For example, the operation period can be between approximately 10 hours and approximately 12 hours. In this configuration, the heating device 128 can be connected to the main power supply at night or during a period when the portable hand washing station 100*a* is not operating, and upon fully charging, the portable hand washing station 100*a* can provide water at the set temperature (or within a set temperature range) during a large majority of the day without a continuous supply of power (or without power whatsoever).

Alternatively or additionally, the battery 144 can be charged using an external power supply when the portable hand washing station 100*a* is not operating or deployed. The portable hand washing station 100*a* can include one or more photovoltaic (PV) panels in electrical communication with the battery 144. The PV panels can function as the external power supply. As such, the PV panels can charge the battery 144 when the portable hand washing station 100*a* is not operating or deployed. Alternatively, the PV panels can provide a power supply during operation or deployment of the portable hand washing station 100*a*. Once the battery 144 is sufficiently charged, the portable hand washing station 100*a* can be disconnected from the main power supply, such that the pump 124 and/or heating device 128 can operate for an operational period without an external supply of power. For example, the operational period can be at least between approximately 10 hours and approximately 12 hours. As will be appreciated, the portable hand washing system 100*a* can include an insulated water tank 116, a heating device 128, and a battery 144. In such a configuration, the water can be heated by an external heating device and/or the water can be heated by the heating device 128 (e.g., while the battery 144 of the portable hand washing station 100*a* is charging) and/or the water can be heated via a PV panel-powered heating device. The heated water can be stored in the insulated water tank 116, and the portable hand washing station 100*a* can be deployed (e.g., disconnected from the external power supply). The heating device 128 can be configured to add heat to the water if the temperature of the water falls below the set point. Accordingly, the operational period of the portably hand washing station 100*a* can be substantially extended.

Waste water can be directed from the drain 126 of the sink 108 to the waste water tank 118 via a drain pipe 136. The waste water tank 118 can store between approximately five gallons and approximately twelve gallons of waste water. The waste water tank 118 can be made of any durable material. In some instances, the waste water tank 118 is made of light weight plastic such that the portable hand washing station 100*a* can achieve increased portability. Alternatively, the waste water tank 118 can be made of durable metals, including aluminum, stainless steel, and the like. The waste water tank 118 can include a switch positioned to correspond to an upper threshold amount of waste water in the waste water tank 118. Once waste water reaches the upper threshold, the switch can disconnect the supply of water being directed from the clean water tank 116 to the faucet 110. For example, once the upper threshold of the waste water tank 118 is reached, the pump 124 can be disabled, a valve located between the clean water tank 116 and the faucet 110 can be closed, or any other method for disconnecting or preventing the supply of water can be performed. Alternatively or additionally, once the upper threshold of the waste water tank 118 is reached, the switch can activate a warning indicator. The warning indicator can include mechanical devices that can warn a user of a substantially full tank. By way of example, the warning indicator can include a site gauge or float. The waste water tank 118 can include an outlet, which can optionally be configured to connect to a water hose. Upon connection, the water hose can empty the waste water collected in the waste water tank 118. This configuration eliminates the need to manually empty the waste water tank 118, thereby reducing the risk of contacting dirty or contaminated water.

In order to configure the portable hand washing station 100*a* for operation, a supply of water (e.g. a water hose) can be connected to the clean water tank 116. A valve (e.g., ball valve) disposed proximate an inlet of the clean water tank 116 can be opened in order to allow the supply of water to enter the clean water tank 116. A valve (e.g., ball valve) disposed proximate the outlet of the waste water tank 118 can be opened such that waste water can drain from the waste water tank 118. A bypass conduit (e.g., tubing, piping, or the like) can connect the clean water tank 116 and/or the heating device 128 to the outlet of the waste water tank 118. Air trapped in the clean water tank 116 and/or the heating device 128 can be expelled by substantially filling the clean water tank 116 with water to the point that a stead flow of water is flowing out of the outlet of the waste water tank 118; that is, the clean water tank 116 can become filled or substantially filled with water, which pushes air out of the tank through the bypass conduit and out of the outlet of the waste water tank 118. Once the clean water tank 116 is substantially filled with water and waste water is draining from the waste water tank 118 at a steady flow rate, the tubing from the waste water tank 118 can be disconnected and the valve disposed proximate the outlet of the waste water tank 118 can be closed. The supply of water can further be disconnected from the inlet of the clean water tank 116, and the valve disposed proximate the inlet of the clean water tank 116 can be closed. The portable hand washing station 100*a* can be connected to the main power supply such that the heating device 128 can be energized, and the water within the clean water tank 116 can be heated. Once the water within the clean water tank 116 is heated to the set temperature, the portable hand washing station 100*a* can be disconnected from the main power supply such that the portable hand washing station 100*a* can be operable for the operational period.

In response to a demand for water, water from the clean water tank 116 can be directed to the faucet 110 by the pump 124. The atomizing nozzle 112 can output an ultra-low flow of atomized water. The ultra-low flow of atomized water can be substantially mist-like.

At the end of the operational period of the portable hand washing station 100*a*, the waste water tank 118 can be drained. Tubing can be connected to the outlet of the waste water tank 118, and the valve can be opened. The drain pump 146 can be activated such that the waste water within the waste water tank 118 can be pumped from the waste water tank 118. The drain pump 146 can pump the waste water within approximately 3 to 5 minutes. Once the waste water is drained from the waste water tank 118 and the waste water tank 118 is empty, the drain pump 146 can be turned off and the tubing can be disconnected.

The portable hand washing station 100*a* can further include accessories designed to better the hand washing experience. By way of example, the portable hand washing station 100*a* can include a paper towel dispenser 130. In some instances, the paper towel dispenser 130 can be positioned above the sink 108 for easy access. The portable hand washing station 100*a* can include a soap dispenser 132. In some instances, the soap dispenser 132 can be positioned above the sink 108 for easy access. The soap dispenser 132 can include traditional soap or hand sanitizer. The soap dispenser 132 can be motion activated (e.g., as described above with respect to the faucet 110), such that when an individual's hand(s) is placed proximate to the soap dispenser 132, the soap dispenser 132 can be activated and dispense soap onto the individual's hand. In this configuration, an individual can wash his or her hands without contacting high-contact areas where potential spread of virus or bacteria can occur. The portable hand washing station 100*a* can include a waste container 134 for used paper towels or other sanitary products. The waste container 134 can help reduce accumulation of trash near and around the hand washing station 100*a*. Alternatively or additionally, the portable hand washing station 100*a* can include a motion-activated air dryer (e.g., using motion sensing techniques and devices as described above with respect to the faucet 110), which can further decrease or eliminate any touching of any part of the portable hand washing station 100*a* by a user. The air dryer can be powered by the battery 144, for example.

The portable hand washing station 100*a* can be equipped with a speaker or other sound-producing device, which can be configured to emit an alarm, buzzer, or the like. Following the atomizing nozzle 112 outputting a supply of water for a hand wash for a predetermined duration (e.g., twenty seconds, third seconds), an audible sound can be produced. The audible sound can signal to the user that a hand wash has been complete. Alternatively, the portable hand washing station 100*a* can be configured to automatically shut off the output of water from the atomizing nozzle 112 after the predetermined time (e.g., twenty seconds, thirty seconds).

Although the additional accessories are illustrated in FIG. 1A specifically, it is contemplated that any portable hand washing station 100*a* can include supplemental accessories to better the hand washing experience.

Figure 1B:
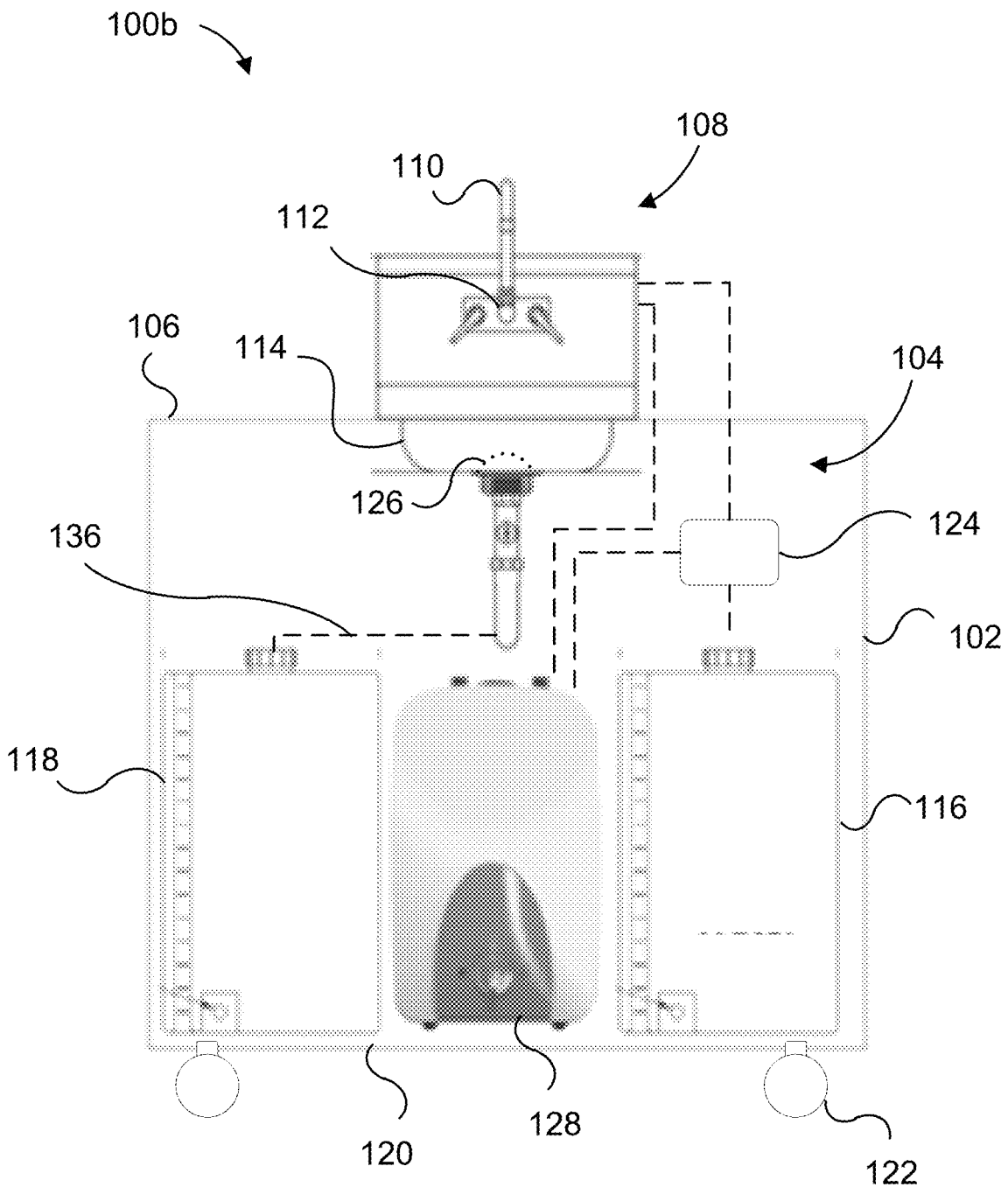

FIG. 1B illustrates an example portable hand washing station 100*b* can include many of the same components as described herein with respect to the example portable hand washing station 100*a* depicted in FIG. 1A. The portable hand washing station can include additional components and/or not include components as described herein with reference to portable hand washing station 100*a*.

As shown in FIG. 1B, the portable hand washing station 100*b* can omit the clean water tank 116 and/or the pump 124 and can instead be configured to receive a supply of water via a water hose. The water hose can provide a supply of water to the faucet 110, such that the portable hand washing station 100*b* can provide unheated and/or heated water as described herein.

The heating device 128 can be a mini tank-based water heater. The heating device 128 can be or include an electric water heater, an instantaneous water heater, a heat pump water heater, a gas water heater, a solar powered water heater, a geothermal water heater, or any combination thereof. The heating device 128 can store between approximately one gallon and approximately three gallons of water. The heating device 128 can be in fluid communication with the clean water tank 116. The heating device 128 can heat the water in the clean water tank 116 to a set temperature. In this configuration, the heating device 128 can provide on-demand heated water. The heating device 128 can store a minimal amount of water (e.g. one to ten gallons). Upon a demand for heated water, the heated water stored in the heating device 128 can be provided. Depending on the demand, additional water can be directed from the clean water tank 116 to the heating device 128 to satisfy the demand.

In response to a demand for unheated water, water from the clean water tank 116 can be directed to the faucet 110 by the pump 124. The pump 124 can appropriately pressurize the water. The atomizing nozzle 112 of the faucet 110 can output an ultra-low flow of atomized water. In response to a demand for heated water, water from the clean water tank 116 can be directed to the faucet 110 by the pump 124. The pump 124 can appropriately pressurize the water. The pressurized water can be directed to the heating device 128. The heating device 128 can heat the pressurized water to a set temperature and direct the heated water to the faucet 110. The atomizing nozzle 112 of the faucet 110 can output an ultra-low flow of atomized water. The drain 126 within the basin 114 of the sink 116 can carry the atomized waste water to the waste water tank 118 via the drain pipe 136.

As a non-limiting example, the portable hand washing station 100*b* can include an eight-gallon clean water tank 116 and can be in electrical communication with the main power supply configured to supply approximately 120 V of power to the heating device 128 and the pump 124, such that the portable hand washing station 100*b* can provide approximately 240 twenty-second hand washes, assuming a flow rate of approximately 0.1 gallons per minute.

Figure 1C:
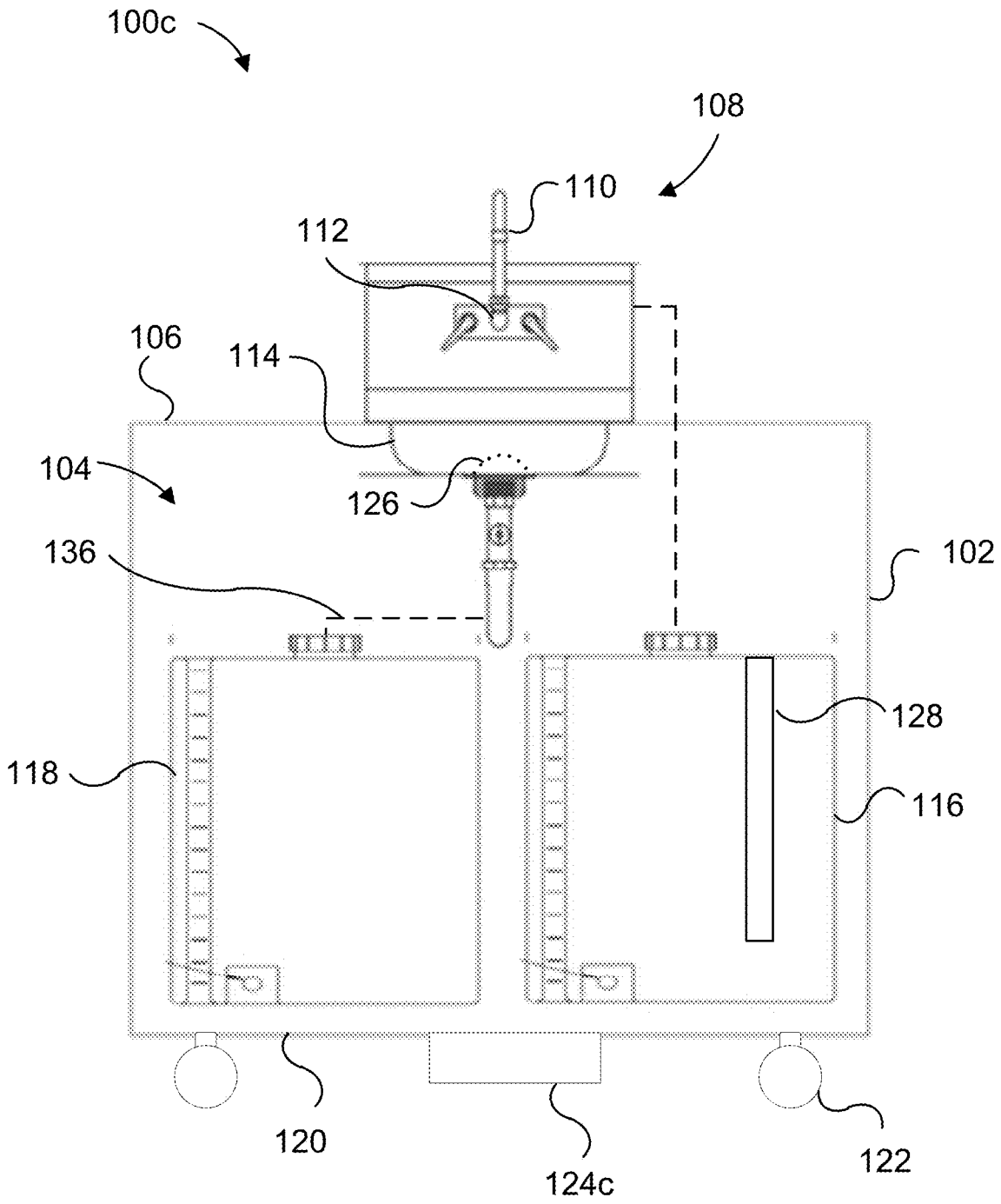

FIG. 1C illustrates an example portable hand washing station 100*c*. The portable hand washing station 100*c* can include many of the same components as described herein with reference to portable hand washing stations 100*a*, 100*b* and depicted in FIGS. 1A and 1B. The portable hand washing station 100*c* can include additional components and/or not include components as described herein with reference to portable hand washing stations 100*a*, 100*b*.

The pump 124 of the example portable hand washing station 100*c* shown in FIG. 1C can be or include a manual pump 124*c* (e.g., a foot-operated pump) that does not require electric power. When the manual pump 124*c* is activated (e.g. by exerting force on the foot-operated pump), a supply of pressurized water can be directed from the clean water tank 116 to the faucet 110. The pump 124*c* can pressurize the water, for example, to a pressure between approximately 20 and approximately 60 psi.

The heating device 128 disposed within the clean water tank 116 can be or include a submersion heater. The submersion heater can include a metal tube, rod, or the like, and one or more temperature sensor. The one or more temperature sensors can be in communication with a controller and/or circuitry such that the controller and/or circuitry can determine a temperature of the water within the clean water tank 116 and output a corresponding instruction to the heating device 128 to increase the heat, if the temperature is below a predetermined temperature or set temperature. The submersion heater can be in direct contact with the water within the clean water tank 116. The submersion heater can be in electrical communication with the main power supply via a power cord and/or in electrical communication with a battery 144. As an example, the main power supply can provide between approximately 1.0 kW to approximately 1.5 kW to the submersion heater via an electric current to sufficiently heat the water within the clean water tank 116 to a set temperature. The main power supply can continue to provide power until the water within the clean water tank 116 reaches a set temperature. The controller and/or circuitry can determine the water within the clean water tank 116 has reached the set temperature based on data form the temperature sensor, and the controller and/or circuitry can then output a signal to the submersion heater to stop heating or reduce the amount of heat being outputted. Alternatively or additionally, the controller and/or circuitry can output a signal to a switch or some other component to prevent power from reaching the submersion heater until the temperature sensor indicates the water within the clean water tank 116 has fallen below the set temperature. Because the water within the clean water tank 116 maintains the approximate set temperature, a water hose or other similar clean water supply can be connected to the portable hand washing station 100*c* in order to provide unheated water.

In response to a demand for unheated water and activation of the pump 124, a supply of pressurized water can be directed from the water hose to the faucet 110. The atomizing nozzle 112 of the faucet 110 can output an ultra-low flow of atomized water. In response to a demand for heated water and activation of the pump 124, heated, pressurized water can be directed from the clean water tank 116 to the faucet 110. The atomizing nozzle 112 of the faucet 110 can output an ultra-low flow of atomized water. The drain 126 within the basin 114 of the sink 116 can carry the atomized waste water to the waste water tank 118 via a drain pipe 136.

An example portable hand washing station 100*c* including a twelve gallon clean water tank 116 and including a 1.2 kW supply of power (e.g., for the heating device 128) can provide approximately 360 twenty-second hand washes, assuming a flow rate of approximately 0.1 gallons per minute.

Figure 1D:
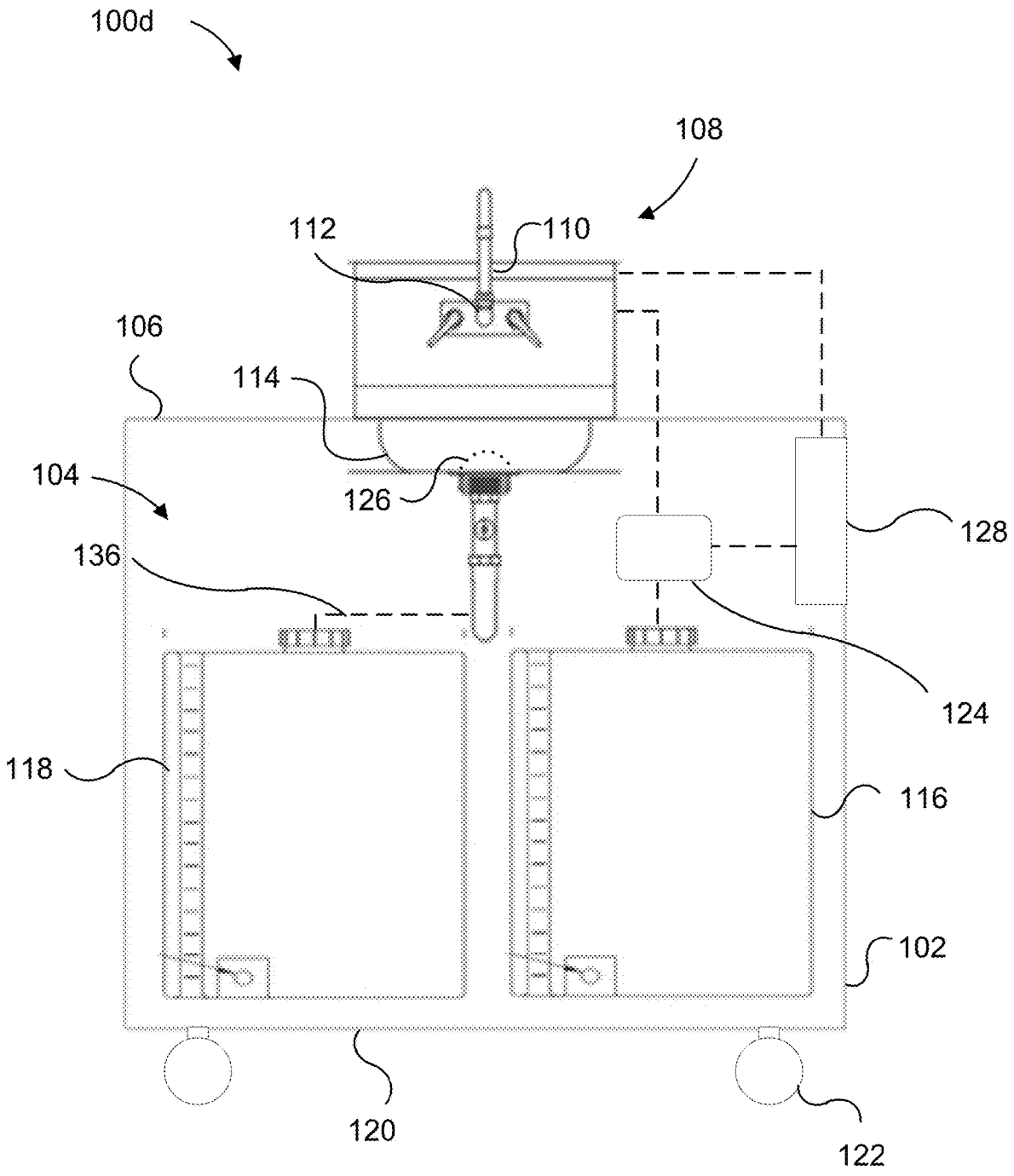

FIG. 1D illustrates an example portable hand washing station 100*d*. The portable hand washing station 100*d* can include many of the same components as described above with reference to portable hand washing stations 100*a*, 100*b*, 100*c* as depicted in FIGS. 1A through 1C. The portable hand washing station 100*d* can include additional components and/or not include components as described above with reference to portable hand washing stations 100*a*, 100*b*, 100*c* as depicted in FIGS. 1A through 1C.

The heating device 128 can be or include an electric tankless water heater (e.g., a water heater having a capacity of less than two gallons). The heating device 128 can be in electrical communication with the main power supply. The main power supply can provide between approximately 120 V of power to the heating device 128, such that the heating device 128 can heat the water to a set temperature.

In response to a demand for unheated water, water from the clean water tank 116 can be directed to the faucet 110 by the pump 124. The pump 124 can appropriately pressurize the water. The atomizing nozzle 112 of the faucet 110 can output an ultra-low flow of atomized water. In response to a demand to a demand for heated water, water from the clean water tank 116 can be directed to the faucet 110 by the pump 124. The pump 124 can appropriately pressurize the water. The pressurized water can be directed to the heating device 128 (e.g. electric tankless water heater). The heating device 128 can heat the pressurize water to a set temperature and direct the heated water to the faucet 110. The atomizing nozzle 112 of the faucet 110 can output an ultra-low flow of atomized water. The drain 126 within the basin 114 of the sink 116 can carry the atomized waste water to the waste water tank 118 via a drain pipe 136.

An example portable hand washing station 100*d* including a twelve-gallon clean water tank 116 and receiving a 120 V supply of power (e.g. for the pump 124 and/or the heating device 128) can provide approximately 360 twenty-second hand washes, assuming a flow rate of approximately 0.1 gallons per minute.

Although FIGS. 1A-1D illustrate example portable hand washing stations 100, each including a sink 108 with a single basin 114, it is contemplated that the portable hand washing station 100 can include multiple sinks 108 and/or multiple basins 114. Optionally, the portable hand washing station 100 can include a separation guard (e.g., wall or barrier) to isolate each sink 108 of a multi-sink portable hand washing station. The separation guard can prevent the spread of germs and the like between multiple users (e.g., users simultaneously using adjacent sinks). The separation guard can be made of any durable material, including plastic, plexi glass, metal, and the like. The separation guard is translucent. Alternatively, the separation guard can be opaque.

Figure 2:
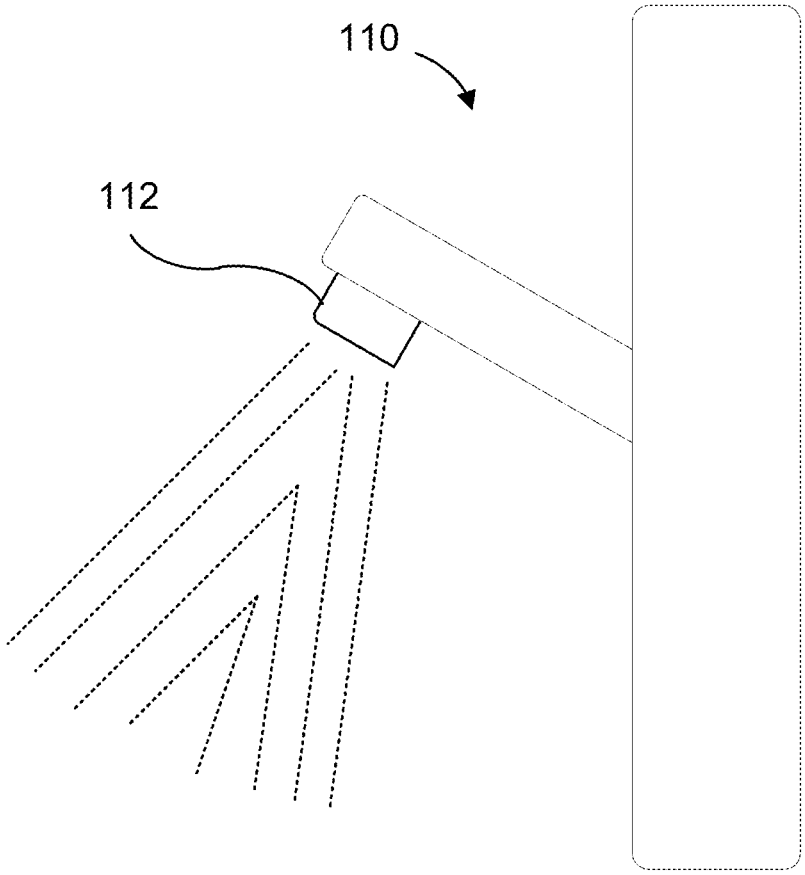
FIG. 2 illustrates an example atomizing nozzle, in accordance with the disclosed technology.

FIG. 2 illustrates an example faucet 110 including an atomizing nozzle 112. The atomizing nozzle 112 can be retrofitted onto a faucet (e.g. a traditional, manually operated faucet or a motion-activated faucet), such that the faucet 110 can provide an ultra-low flow of atomized water. Alternatively, the atomizing nozzle 112 can be manufactured in the faucet 110. The atomizing nozzle 112 can be configured to atomize water according to any atomizing method.

For example, the atomizing nozzle 112 can combine water from the clean water tank 116 with compressed air from a compressed air source to create a mist-like supply of clean water streaming from the faucet 110. The compressed air source can be an air compressor, an aerosol mixture, a compressed air tank, or any other suitable compressed air source for the application. As additional examples, the atomizing nozzle 112 can include an ultrasonic atomizer, a rotary atomizer, a twin-fluid atomizer, an electrostatic atomizer, or any other suitable atomizer such that an ultra-low flow of atomized water can be provided. As one of skill in the art will appreciate, the chosen component and/or method of atomizing the water can be capable of atomizing water at an ultra-low flow rate such that the overall amount of water used is reduced.

The atomizing nozzle 112 can produce a variety of spray patterns. In some instances, the atomizing nozzle 112 can produce a substantially conical mist-like spray of liquid. The atomizing nozzle 112 can increase liquid dispersion while decreasing the rate of liquid consumption. For example, the atomizing nozzle 112 can use 80-85% less water than a traditional faucet having a flow rate greater than 0.1 gallons per minute. The atomizing nozzle 112 can provide a lower flow rate as compared to traditional faucets of portable hand washing stations.

As one skilled in the art will appreciate, traditional portable hand washing stations typically provide water at a flow rate of greater than 0.1 gallons per minute (e.g. 0.2 to 0.5 gallons per minute). Unlike traditional portable hand washing stations, the atomizing nozzle 112 can provide an ultra-low-flow rate between approximately 0.01 gallons per minute and approximately 0.5 gallons per minute. As another example, the atomizing nozzle 112 can provide a flow rate that is between approximately 0.01 gallons per minute and approximately 0.15 gallons per minute. The atomizing nozzle 112 can result in a significant increase in the number of twenty second hand washes the portable hand washing station 100 can provide due to its ultra low-flow rate. By way of example, assuming an average 20 seconds per hand wash, a traditional faucet without the atomizing nozzle 112 can provide only approximately 30 individual hand washes per six-gallon supply of clean water, approximately 17 individual hand washes per four-gallon supply of clean water, and 10 individual hand washes per 2.5-gallon supply of clean water. In contrast, assuming the same average 20 seconds per hand wash, the faucet 110 including the atomizing nozzle 112 can provide approximately 144 individual hand washes per six-gallon supply of clean water, approximately 96 individual hand washes per four-gallon supply of clean water, and approximately 60 hand washes per 2.5-gallon supply of clean water.

The ultra-low flow rate between approximately 0.01 gallons per minute to approximately 0.5 gallons per minute achieved by the atomizing nozzle 112 can enable instantaneous water heating. By way of example, a 1.2 kW water heater can provide a water temperature change of approximately 27° F. when used in combination with a faucet providing a flow of water at 0.3 gallons per minute. Similarly, a 1.2 kW water heater can provide a water temperature change of approximately 41° F. when used in combination with a faucet providing a flow of water at 0.2 gallons per minute. In contrast, a 1.2 kW water heater can provide a water temperature change of approximately 82° F. when used in combination with the faucet 110 having the atomizing nozzle 112, and thus, being configured to provide an ultra-low flow rate of water at 0.1 gallons per minute.

Figure 3:
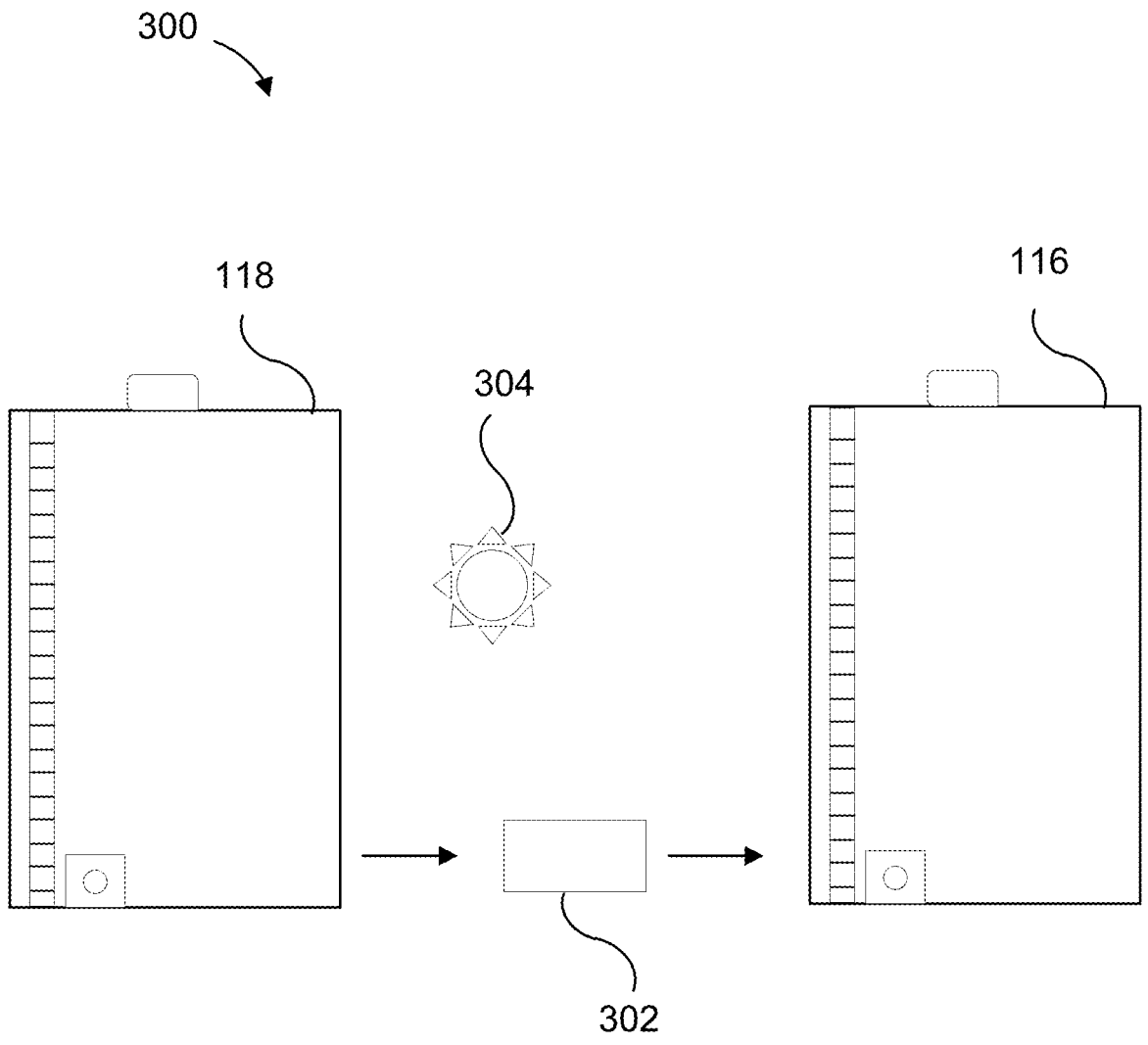
FIG. 3 illustrates an example water recycling system, in accordance with the disclosed technology.

FIG. 3 illustrates an example water recycling system 300. Waste water connected in the waste water tank 118 can be cleansed, filtered, and recycled such that the waste water can be used again as clean water within the clean water tank 116. The recycling system 300 can include filtering the waste water using one or more low-micron filters 302. The recycling system 300 can include disinfecting the waste water using ultraviolent radiation 304. In some instances, the waste water can be pre-treated with various anti-bacterial solutions to facilitate recycling of the waste water. The cleansed and filtered waste water can be directed back into the clean water tank 116 via a pump system. The example water recycling system 300 can significantly reduce the storage tank size of the clean water tank 116. By reducing the storage tank size of the clean water tank 116, the hand washing station 100 can also be reduced in size and can be easier to move and operate in remote and/or non-remote areas.

Figure 4:
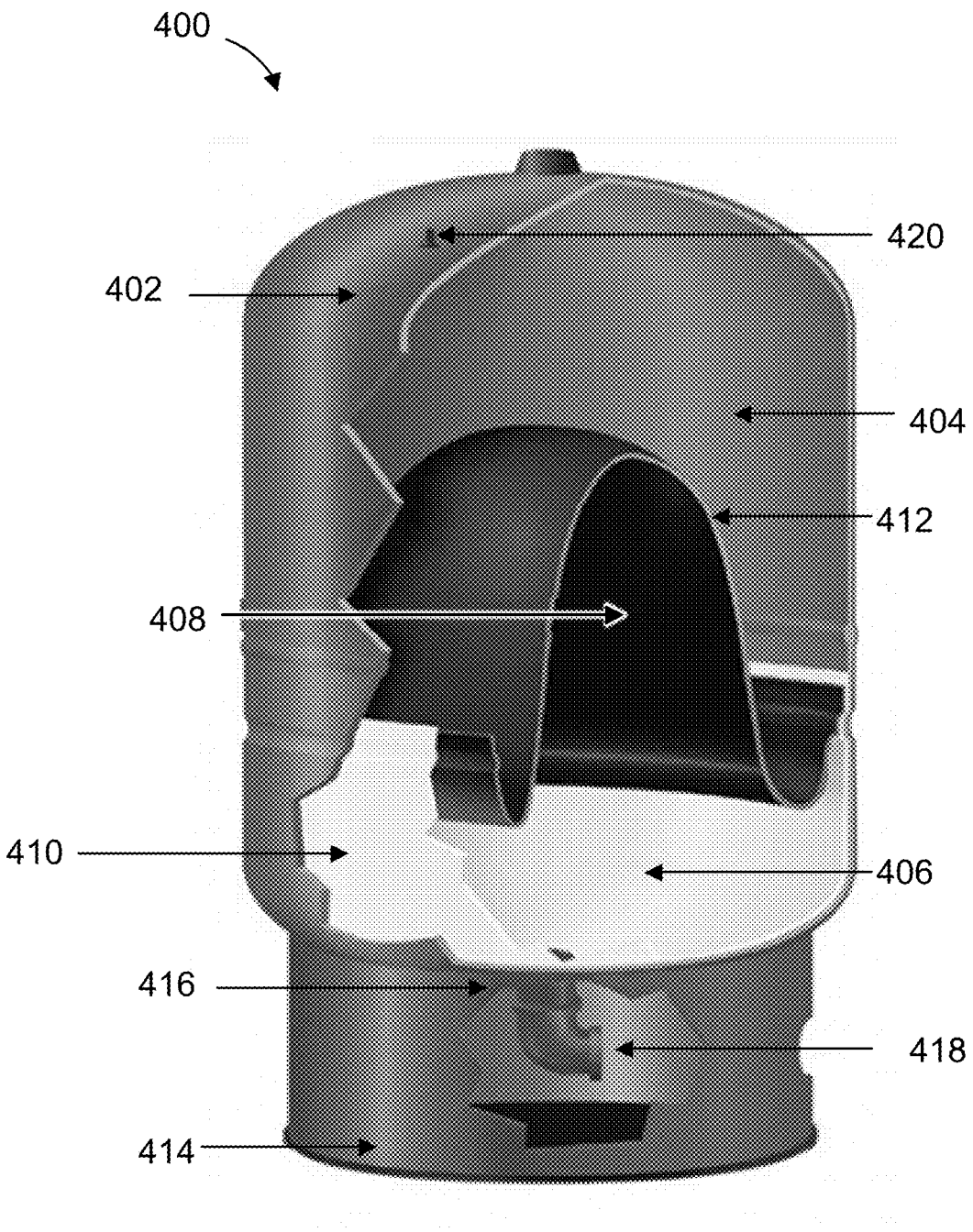
FIG. 4 illustrates an example pressure tank, in accordance with the disclosed technology.

FIG. 4 illustrates an example pressure tank 400. The portable hand washing station 100 can be equipped with the pressure tank 400 in order to provide pressurized water without the need for a pump, thereby decreasing the required supply of power needed for the portable hand washing station 100 to operate effectively.

The pressure tank 400 can be disposed within the cavity 104 of the housing 102 of the portable hand washing station 100. The pressure tank 400 can be in fluid communication with the faucet 110 having the atomizing nozzle 112 such that the portable hand washing station 100 can provide an ultra-low flow of atomized water. By way of example, a ten-gallon pressure tank 400 can provide approximately 300 twenty second hand washes when using an ultra-low flow rate of approximately 0.1 gallons per minute.

The pressure tank 400 can include an insulating shell 402. The insulating shell 402 can be made substantially of steel. The insulating shell 402 can be coated with one or more layers of weather-resistant paint to protect the pressure tank 400 from environmental elements.

The pressure tank 400 can be separated into an air portion 404 and a water portion 406. The water portion 406 can include a watertight liner 410. The watertight liner 410 can provide reduce corrosion. The watertight liner 410 can be a polypropylene liner.

As illustrated in FIG. 4, the pressure tank 400 can be a diaphragm pressure tank. The pressure tank 400 can include a diaphragm 412 positioned to separate the air portion 404 from the water portion 406. The diaphragm 412 can be made flexible, durable material, including rubber, butyl, and the like. The diaphragm 412 can include a liner 408 (e.g., a polypropylene liner). The liner 408 can cover the side of the diaphragm 412 exposed to the air portion 404 and the side of the diaphragm 412 exposed to the water portion 306. Alternatively, the liner 408 can only cover the side of the diaphragm 412 exposed to the water portion 406. The polypropylene liner 408 can meet NSF 61 requirements for potable water, as an example. The flexible material of the diaphragm 412 can allow the diaphragm 412 to flex upon the influx of water into the water portion 406 and absorb any pressure changes (e.g. pressure surges). The flexible material of the diaphragm 412 can minimize stretching and creasing of the diaphragm 412, which can extend the useful life of the diaphragm 412. The ability to flex upon the influx of water, thereby pressurizing the water within the water portion 406 can allow the pump to only operate intermittently. By operating only intermittently when the water portion 406 needs to be refilled, the motor can cool, thereby expanding the lifespan of the diaphragm 412 and, thus, the pressure tank 400.

The pressure tank 400 can include a base 414. The base 414 can be similarly made of steel and can be coated with one or more layers of weather-resistant paint for protection. A waterway 416 can extend from the water portion 406 into the base 414, as illustrated in FIG. 4. The waterway 416 can be an inlet for providing a supply of water to the water portion 406 and/or an outlet for draining water from the water portion 406. The waterway 416 can be welded to the pressure tank 400 at the base 414 to provide a watertight seal. The waterway 416 can connectable to a pipe fitting 418. The pipe fitting 418 can include a stainless steel insert. The pipe fitting 418 can be connectable to a supply of water (e.g., via a water hose) or other plumbing, tubes, piping, and the like, which can help facilitate the supply of water into the water portion 406 and the output of water from the water portion 406.

When the pressure tank 400 is connected to a supply of water, water can enter the water portion 406. As the water portion 406, fills with water, the diaphragm 412 can flex. The flexing of the diaphragm 412 can compress the air in the air portion 404. As the air continues to compress, the pressure within the pressure tank 400, and thereby the water within the water portion 406 can increase. When an appropriate or predetermined pressure is reached, the supply of water can be disconnected. Upon a demand for water, the pressure tank 400 can provide pressurized water without the need for a pump.

In some instances, the pressure tank 400 can be a bladder pressure tank. The water portion 406 can include a balloon configured to store water and separate the water portion 406 and the air portion 404. By separating the water portion 404 and the air portion 406, the stored water does not come into contact with the insulating shell 402, thereby minimizing corrosion. Upon the influx of a supply of water, the balloon can expand. As the balloon expands, the balloon can compress the air in the air portion 404. The balloon can expand to substantially the entire volume of the pressure tank 400 such that the tank volume and balloon volume are substantially the same. As the air continues to compress, the pressure within the pressure tank 400, and thereby the water within the balloon of the water portion 404 can increase. When an appropriate pressure is reached, the supply of water can be disconnected. Upon a demand for water, the pressure tank 400 can provide pressurized water without the need for a pump.

The pressure tank 400 can include an air release valve 420 disposed on the insulating shell 402. The air release valve 420 can protect the pressure tank 400 from excessive pressure build-up. If the pressure within the pressure tank 400 exceeds a predetermined pressure, the air valve 420 can be opened. Upon releasing an amount of air from the air valve 420, the pressure within the pressure tank 420 can decrease.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

What is claimed is:

1. A portable hand washing station comprising:
a housing defining a cavity;
a sink attached to the housing, the sink including:
a faucet having an atomizing nozzle configured to provide an ultra-low flow of atomized liquid; and
a basin having a drain;
a clean water tank disposed within the cavity and being in fluid communication with the faucet;
a waste water tank disposed within the cavity and being in fluid communication with the drain;
a pump configured to transport liquid from the clean water tank to the faucet; and
a heating device configured to heat liquids, the heating device being in fluid communication with the clean water tank and the faucet; and
a water recovery system configured to recycle waste water collected in the waste water tank, the water recovery system comprising:
one or more low-micron filters, and
an ultraviolet light source.

2. The portable hand washing station of claim 1, wherein the atomizing nozzle is configured to provide an ultra-low flow of liquid between approximately 0.01 gallons per minute and approximately 0.15 gallons per minute.

3. The portable hand washing station of claim 1, wherein the portable hand washing station is configured to provide between approximately 140 and 400 hand washes, each hand wash having a duration of approximately 20 seconds.

4. The portable hand washing station of claim 1, further comprising one or more wheels affixed to a bottom surface of the housing.

5. The portable hand washing station of claim 1, wherein the heating device is a submersion heater disposed within the clean water tank.

6. The portable hand washing station of claim 1, wherein the heating device is an electric tankless water heater.

7. The portable hand washing station of claim 1, wherein the heating device is in fluid communication with the clean water tank and the clean water tank is configured to store between approximately 5 gallons and approximately 12 gallons of heated water.

8. The portable hand washing station of claim 7, wherein the heating device is configured to maintain a predetermined water temperature for a predetermined operational period without a supply of power.

9. The portable hand washing station of claim 8, wherein the predetermined operational period is between approximately 10 hours and approximately 12 hours.

10. The portable hand washing station of claim 7, wherein the heating device includes insulation.

11. The portable hand washing station of claim 7, wherein the heating device is a tank-based water heater configured to store between approximately 1 gallon and approximately 10 gallons of liquid.

12. The portable hand washing station of claim 1, wherein the pump is an electric pump.

13. The portable hand washing station of claim 1, wherein the pump is a manually operable pump.

14. The portable hand washing station of claim 1 further comprising a battery.

15. A portable hand washing station comprising:
a housing defining a cavity;
a sink attached to the housing, the sink including:
a faucet having an atomizing nozzle configured to provide an ultra-low flow of atomized liquid; and
a basin having a drain;
a clean water tank disposed within the cavity and being in fluid communication with the faucet;
a waste water tank disposed within the cavity and being in fluid communication with the drain;
a pump configured to transport liquid from the clean water tank to the faucet; and
a waste water pump configured to expel waste water from the waste water tank and a by-pass conduit fluidly connecting the clean water tank to the waste water tank.

16. A portable hand washing station comprising:
a housing defining a cavity;
a sink attached to the housing, the sink including:
a faucet with an atomizing nozzle configured to provide an ultra-low flow of atomized liquid;
a basin having a drain;
a waste water tank disposed within the cavity and being in fluid communication with the drain;
a pressure tank disposed within the cavity and being in fluid communication with the faucet, the pressure tank including:
a steel shell;
a water portion having a watertight liner;
an air portion; and
an air valve disposed on the shell and in fluid communication with the air portion; and
a heating device configured to heat liquids, the heating device being in fluid communication with the pressure tank and the faucet.

17. The portable hand washing station of claim 16, wherein the pressure tank is configured to provide pressurized water during an operational period without a supply of power.

18. The portable hand washing station of claim 16, wherein the pressure tank is a diaphragm pressure tank.

19. The portable hand washing station of claim 16, wherein the pressure tank is a bladder pressure tank.

* * * * *